United States Patent [19]

Houser

[11] 3,963,358

[45] June 15, 1976

[54] PAPER DISPENSING PEN

[76] Inventor: Roy W. Houser, 4060 Mount Brundage Ave., San Diego, Calif. 92111

[22] Filed: Feb. 12, 1975

[21] Appl. No.: 549,161

[52] U.S. Cl. ..... 401/195; 40/335

[51] Int. Cl.[2] ..... B43K 29/12; B43K 29/20

[58] Field of Search ..... 401/52, 195; 242/55.53, 242/107.6; 40/335

[56] References Cited

UNITED STATES PATENTS

| | | | |
|---|---|---|---|
| 2,224,470 | 12/1940 | Boust | 401/52 X |
| 2,287,618 | 6/1942 | Josephs | 242/55.53 |
| 2,331,675 | 10/1943 | Frost | 242/55.53 |

FOREIGN PATENTS OR APPLICATIONS

| | | | |
|---|---|---|---|
| 1,043,580 | 6/1953 | France | 401/195 |
| 484,630 | 5/1938 | United Kingdom | 401/52 |

*Primary Examiner*—Lawrence Charles
*Attorney, Agent, or Firm*—Ralph S. Branscomb

[57] ABSTRACT

The invention is a ball point pen or the like having an internal mechanism to dispense writing paper from a small roll of same confined within a cylindrical cartridge contained within the pen housing or sheath. The cartridge has a knurled collar which is thumb-operated through an opening in the exterior sheath of the pen to rotate the cartridge approximately one-quarter turn against a spring bias to project the leading edge of the paper roll through a slot in the pen sheath, where it may be gripped and pulled by the user to unroll a desired length and then torn off. Prior to tearing the paper from the remaining roll, the knurled collar is released to withdraw the paper a quarter turn into the sheath so that a sufficient length of leading edge remains for the next dispense.

12 Claims, 15 Drawing Figures

24
22
23
20
28
48
5
5

24
40
36
38
26
34
52
20
22
23
70
68
32
28
48

24
13
13
20
66
62
22
70
68
30
32
28
48

22
70
62
66
32
52
68
34
54
72
30
28
48

PAPER DISPENSING PEN

BACKGROUND OF THE INVENTION

The invention relates to ball point pens, automatic pencils and the like having the capability of dispensing paper from a self-contained supply so that the user may make a record of telephone numbers, addresses and other brief memoranda in places where an alternative supply of paper may not be readily available.

There have been several attempts to develop small paper dispensing assemblies for use integrally with a pen or automatic pencil, or on the frames of eyeglasses. These efforts have uniformly produced devices comprising two basic parts, namely, an outer cylindrical sheath having a slot therein and an interior reel having the paper would thereon and which feeds the paper through the slot in the outer sheath.

Of these devices, some have paper rolls displaying calendars, maps, or other charts whose use is intended to be repetitive, as exemplified by U.S. Pat. Nos. 485,261 and 260,143. Typically the leading edge of the paper roll of these units is provided with a marginal bar to prevent complete retraction of the paper into the cylindrical casing, and the interior reel is spring-loaded to provide a constant retracting tension on the roll so that smooth operation is effected and no jambing or buckling of the paper inside the casing occurs.

However, dispensers of disposable paper such as writing paper involve problems not evident in the abovementioned paper dispensers, these problems stemming from the fact that it is desirable to retract the paper completely within the outer casing and out of the way when it is not being used. Of course, in this position the leading edge of the paper cannot be gripped and pulled out with the fingers, so the internal reel must be driven somehow to project the paper through the casing slot, and in so doing, the paper roll, which has a natural tendency to expand anyway, jambs and buckles inside the casing and renders proper operation problematic, if not impossible, over a period of time.

In addition, the prior art devices in general are constructed with the paper dispenser as the focal point and the remaining structure designed accordingly so that special tooling would be required to produce many, if not all, parts of the units.

SUMMARY OF THE INVENTION

The present invention represents a solution to the abovementioned problems and comprises in essence a ball point pen having as a paper dispensing assembly a hollow cylindrical roll-containing cartridge so that the paper is internally contained by the rotating member, rather than being wound on an open reel. The cartridge has an axial void through which the ball point ink cartridge extends, and a longitudinal slot along one side through which the leading end of the paper projects and bears lightly on the interior of the pen housing or sheath. A slot in the sheath has an inwardly-struck beveled edge to guide the paper into and through this slot when the cartridge is rotated in the proper direction, this rotation being effected by the thumb of the user on a knurled collar of the paper cartridge which is accessible through an opening in the pen sheath. Once the leading edge of the paper is extended through the sheath slot, it can be gripped by the user, and the spring-loaded cartridge reverse-rotates a quarter turn prior to the withdrawing the paper, this reverse rotation ensuring that enough of a leading edge remains on the roll to make the next dispense possible.

With the exception of three specially designed parts, the pen is constructed from conventional components or slight modifications thereof so that initial tooling-up costs for mass production of the units is minimal.

DETAILED DESCRIPTION OF THE PREFERRED EMBODIMENT

Figures 1, 2, 3, 4:
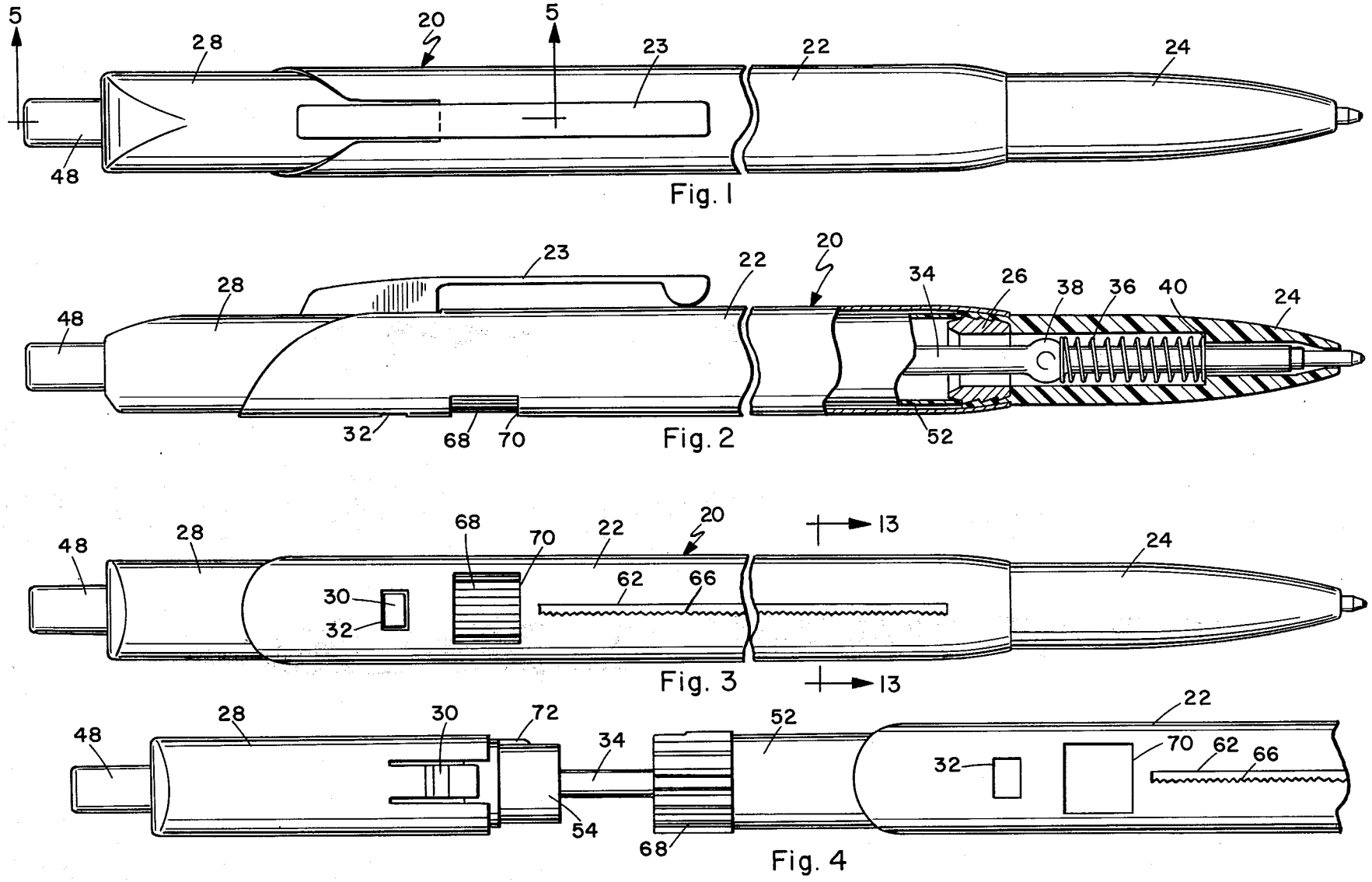
FIG. 1 is a top plan view of the pen.
FIG. 2 is a side elevation view, with portions cut away.
FIG. 3 is an underside view of the pen.
FIG. 4 is an underside view with the components partially separated.
Figure 5:
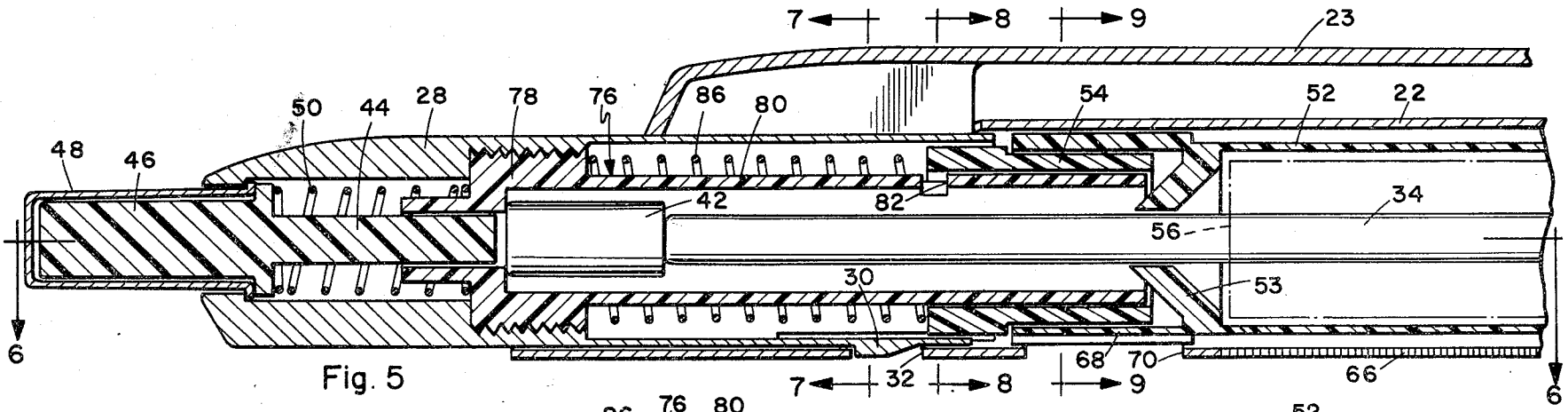
FIG. 5 is an enlarged sectional view taken on line 5—5 of FIG. 1.
Figure 6:
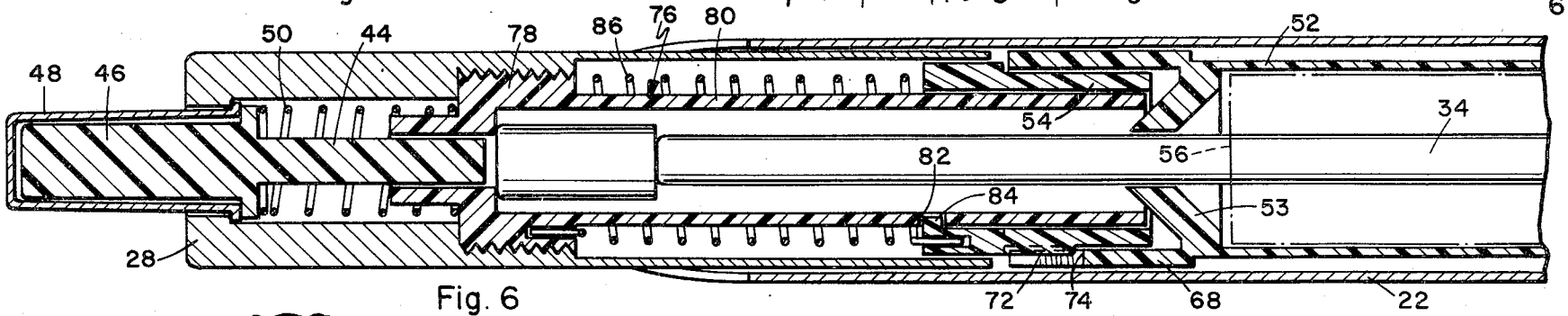
FIG. 6 is a sectional view taken on line 6—6 of FIG. 5.

The pen, shown in overview in FIG. 1, has a body 20 comprising a central sheath 22, which may be made of tubular aluminum, a clip 23, and a tip 24 of plastic construction which is joined to the sheath by the threaded expansion ring 26 or other suitable means. A plastic pen cap 28 is slideably received within the sheath and is releasably received in place such as by a spring detent 30 molded integrally with the cap and which snaps into engagement with a notch 32 in the sheath when the two parts are joined.

The ink cartridge 34 and the associated, diagrammatically illustrated, retraction assembly are conventional, and include a spring 36 captured between a boss 38 on the ink cartridge and an annular shoulder 40 in the pen tip. The other end of the ink cartridge is buttressed by a block 42 diagrammatically representing the retract mechanism, which is operated by a plunger 44 having an externally projecting shank 46 fitted with a protective metal cover 48, the plunger and cover being biased outwardly by the spring 50. In conventional fashion, the ink cartridge is alternately projected and retracted by successively depressing the cover 48. So far the structure is ordinary.

Disposed within the sheath 22 of the pen is a cartridge 52 which abuts the ring 26 at its tip end and is held in place at its head end by a plug 54 as will be described hereinafter there being an inwardly slanted annular support 53 on the cartridge interior to maintain the proper relative positioning between the cartridge 52 and the ink cartridge. The cartridge would normally contain a roll of paper 56 having a leading edge or end 58 which extends through a longitudinal slot 60 in the cartridge and lies against the interior of the sheath 22. The cartridge is angularly positioned in its inactivated mode such that the slot 60 therein lies about one-quarter of a turn from a second slot 62 in the sheath, this slot having an inwardly turned lip 64 on the side thereof remote from the slot 60 such that upon the cartridge turning in the direction indicated by the arrow in FIG. 13 the lip guides the leading edge of the paper through the slot so that it is accessible outside of the pen as shown in phantom in FIG. 13. It will be noted that once the leading edge of the paper is in this position, it may be manually drawn from the roll within the cartridge regardless of which of the angular attitudes illustrated in FIG. 13 of the cartridge assumes. In use, when the desired length of paper has been withdrawn, it is torn off against the edge of the slot 62, which is preferably serrated as is best shown at 66 in FIG. 3.

Figure 9:
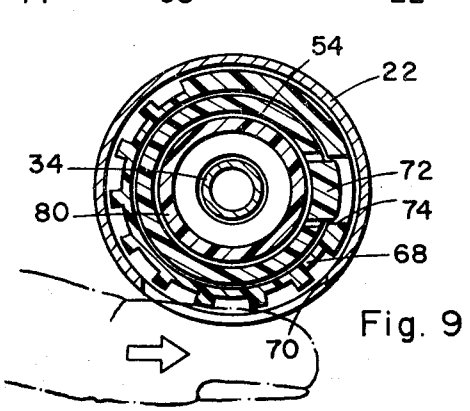
FIG. 9 is a sectional view taken on line 9—9 of FIG. 5.
Figure 8:
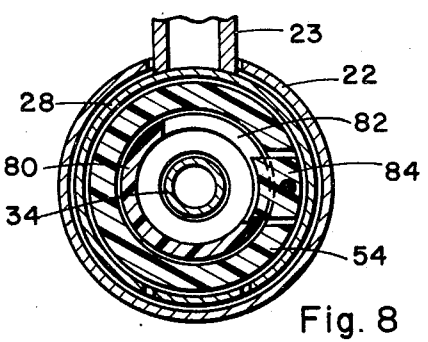
FIG. 8 is a sectional view taken on line 8—8 of FIG. 5.
Figure 7:
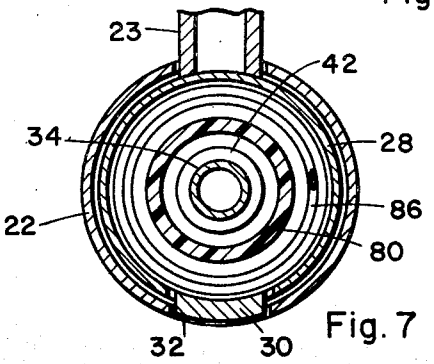
FIG. 7 is a sectional view taken on line 7—7 of FIG. 5.
Figure 11:
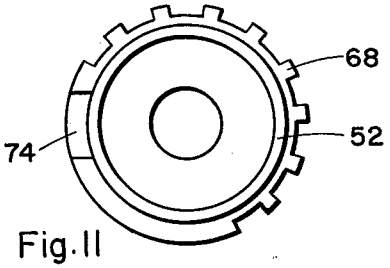
FIG. 11 is an enlarged view as taken from the left hand end of FIG. 10.

Rotation of the cartridge is accomplished by turning a collar 68 disposed at the head end of the cartridge, the collar being accessible through an opening 70 in the sheath and being provided at least in part with a knurled outer surface. This operation is illustrated in FIG. 9. The collar is engaged on a reduced portion of the cylindrical surface of the plug 54 and is prevented from relative rotation therewith by means of a raised key 72 which seats into the slot 74 of the collar, this construction permitting the cartridge to be easily separated from the plug when replacement is needed, as shown in FIG. 4.

The plug is journalled on a structural member 76, which may be part of the retract mechanism, and has an enlarged threaded heat 78 which is screwed into the cap 28, and a hollow cylindrical portion 80 which extends into the plug. The cylindrical portion 80 has an annular track or keyway 82 which subtends about 90° of the cylindrical wall, and fitted in this keyway is a key 84 projecting inwardly from the plug 54. It can thus be seen that the plug and therefore the cartridge, is captured on the structural member 76 and restrained to a rotational movement limited to 90° relative to the remaining portions of the pen.

Figure 13:
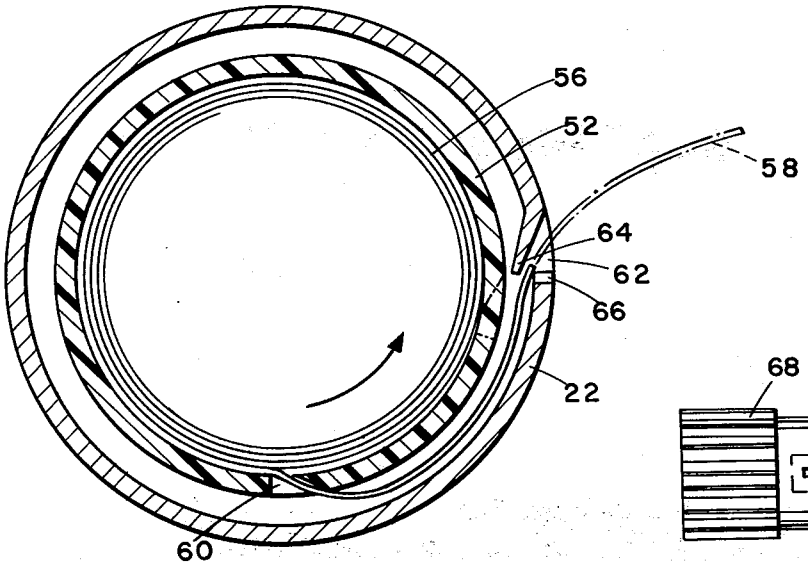
FIG. 13 is an enlarged sectional view taken on line 13—13 of FIG. 3, showing the paper ejection action.

Finally, a coil spring 86 is disposed on the cylindrical portion with the head end thereof engaged in the head 78 of the structural member and the other end engaged by the plug 54 such that a torsional force exists in the spring which biases the cartridge and plug in the clockwise direction relative to the remainder of the pen as viewed in FIG. 13.

Returning to the operation of the paper dispensing apparatus, when the cartridge is turned as in FIG. 13 to expose the end 58 of the paper roll, it is done against the restraining force of the spring 86, and the total rotation is limited to 90° as indicated in that figure. After the leading edge of the paper is gripped, the knurled collar 68 is released so that the cartridge is returned to the clockwise position. When the desired length of paper is withdrawn from the cartridge and torn off, there still remains a quarter turn of leading edge of the paper within the sheath and outside the cartridge, ready for the next dispense.

It will be noted at this point that the dispensing of the paper is virtually foolproof, since there is no possibility of the paper jambing within the cartridge, or between the cartridge on the sheath, if the paper is of the proper weight. The paper is pulled out of the sheath, rather than being pushed as it would be with an open reel dispenser, the initial quarter turn being accomplished by driving the paper roll by its outer surface.

Figure 12:
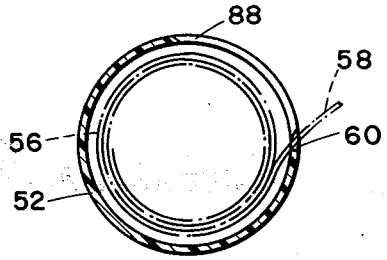
FIG. 12 is an enlarged sectional view taken on line 12—12 of FIG. 10.
Figure 10:
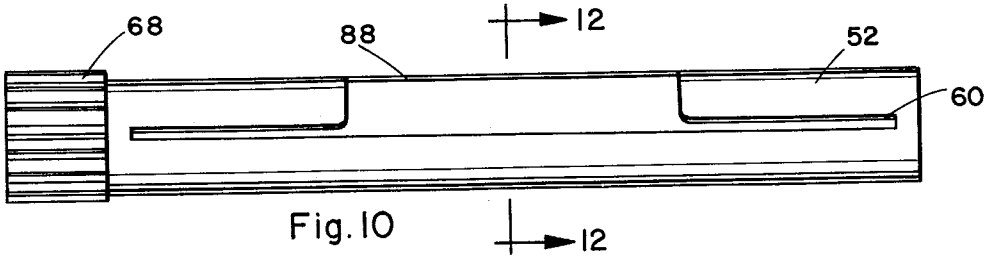
FIG. 10 is a side elevation view of the paper cartridge.

Several minor variations of the cartridge design may be made to accommodate several different methods of rolling and loading the paper within the cartridge, particular attention being given to simplicity of rolling and loading such that the leading edge projects properly from the cartridge slot. In the embodiment shown in FIGS. 10 and 12, the slot 60 in the cartridge has a central expended portion 88 so that a similarly shaped tab on the leading edge of a preformed roll of paper may be easily drawn through the opening.

Figure 14:
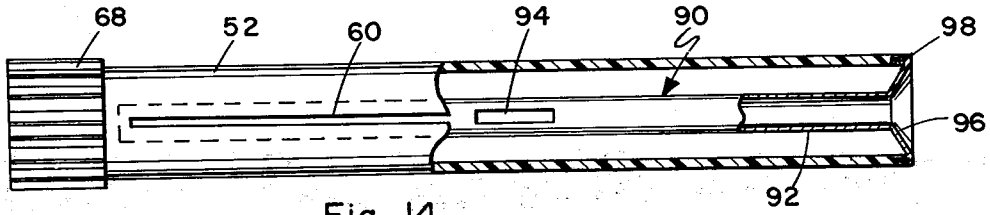
FIG. 14 is a side elevation view, partially cut away, of an alternative paper cartridge.

FIG. 14 illustrates a cartridge having a slot which extends to the right edge thereof and utilizes a spool 90 having a spindle 92 with a slot 94 to receive a tab lead so that the paper can be pre-wound with the aid of a winding mandrel, the spool then being inserted into the open end of the cartridge with the leading edge portion sliding into the open slot from the end. An end cap 96 of the spool has an annular groove 98 in the interior face thereof into which the open cylinder end seats to form a substantially enclosed cartridge assembly.

Figure 15:
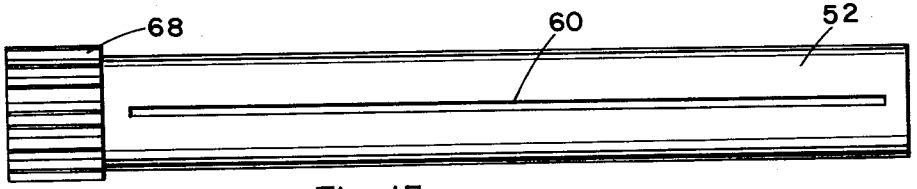
FIG. 15 is a side elevation view of a further paper cartridge.

The cartridge illustrated in FIG. 15 is the simplest, there simply being the slot 60 into which paper from a large paper supply is inserted and wound within the cartridge by an appropriate mandrel, and then cut to leave a sufficient leading edge outside the cartridge.

All three of the cartridge types illustrated contain the paper inside rather than being externally wound in reel fashion, and thus are equally advantageous from a user's point of view. Although in use it has not been found necessary, it is entirely possible that the internal surface of the cartridge, which actually does the driving of the paper roll for the first quarter turn, could be coated with a frictional substance, to ensure that no slippage occurs between the cartridge and the paper.

I claim:

1. A paper dispensing assembly comprising:

a. generally cylindrical sheath substantially defining an enclosure and having a longitudinal slot therein;

b. a generally cylindrical hollow cartridge longitudinally extended within said sheath, said cartridge being self-contained and removable from said sheath and having a longitudinal slot therein to permit the passageway therethrough of paper from a roll contained with the cartridge;

c. said cartridge being spaced from at least a portion of said sheath adjacent to slot therein to define a space for a projecting end of paper extending through the slot in said cartridge;

d. means permitting the limited rotation of said cartridge relative to said sheath;

e. control means operatively connected to said cartridge and accessible from externally of said sheath for rotating said cartridge, whereby the free end of a roll of paper contained within the cartridge and threaded through the slot therein can be positively driven through or retracted from the slot in said sheath by operating said control means to rotate said cartridge.

2. Structure according to claim 1, wherein said sheath has an opening therein and said control means comprises a collar portion of said cartridge accessible through said opening whereby said cartridge can be finger-rotated from externally of the sheath.

3. Structure according to claim 1 wherein the slot in said cartridge is narrow in its extremities and centrally expanded to simplify locating the leading tab of a pre-rolled paper roll loaded therein.

4. Structure according to claim 1 and including a paper-wound spool disposed in said cartridge and said cartridge is a thin-walled cylinder and the slot therein extends therethrough and is open at one end thereof, and said spool comprises a paper-wound spindle having a cap integrated with one end thereof, said cap having an annular groove facing and coaxial with said spindle and dimensioned to receive in seating relatio ship the open end of said cartridge, whereby said paper-wound spool can be loaded into the cartridge with the gree end of the paper passing through said slot, the cap of the spool engaging the end of the cylinder to reinforce same and define a completely enclosed paper-containing cartridge when assembled.

5. Structure according to claim 1 and including means to positively limit the rotation of said cartridge to on the order of one quarter turn relative to said sheath.

6. Structure according to claim 1 and including spring means to bias said cartridge in one rotational direction relative to said sheath, whereby the free end of a roll of paper loaded in said cartridge and threaded through the slot therein in the counter-bias direction will be biased into a retracted position relative to the slot in said sheath.

7. In a ball point pen having an outer sheath and an ink cartridge extending from the head end of the sheath to the tip end thereof, a paper dispensing assembly comprising:

a. a substantially hollow cylindrical cartridge disposed within said sheath and having a longitudinal slot therein and having a central axial bore receiving said ink cartridge, said cartridge being spaced from at least a portion of said sheath adjacent said slot;

b. a roll of paper disposed within said hollow cartridge, said roll being resilient to expand into frictional contact with the surface of said cartridge, and having the leading edge thereof extending through said slot between said cartridge and said sheath;

c. said sheath also having a longitudinal slot therein of length and axial position substantially equal to the slot in said cartridge;

d. means accessible externally of said sheath to directly rotate said cartridge relative to said sheath such that said roll of paper can be positively rotationally driven by said cartridge so that the leading edge of said paper roll can be extended through the slot in said sheath or retracted therefrom.

8. Structure according to claim 7 and including spring means to rotationally bias said cylindrical cartridge to retract the leading edge of said paper roll from the slot in said sheath.

9. Structure according to claim 7 wherein said sheath has an opening therein and said means to rotate said cylindrical cartridge comprises an annular collar on said cartridge, said collar being at least partially knurled and accessible through this opening in said sheath.

10. Structure according to claim 9 wherein said collar is disposed on the head end of said cylindrical cartridge, and including a support member rigidly mounted in the head end of said sheath and extending into said collar, and further including means positively limiting the rotation of said cartridge relative to said support member.

11. Structure according to claim 10 wherein said limiting means comprises a hollow cylindrical plug journalled on said support member and engaging said collar to prevent relative rotation between said collar and said plug; said plug being keyed in an annular track of limited angular extent in said support member to limit the rotation of said cylindrical cartridge.

12. Structure according to claim 11 wherein said spring means comprises a coil spring disposed on said support member and having one end anchored to said support member and the other end anchored to said plug.

* * * * *